United States Patent [19]

McCord et al.

[11] 4,010,934

[45] Mar. 8, 1977

[54] LIQUID MIXING AND DISPENSING DEVICE

[76] Inventors: King S. McCord; Irene W. McCord, both of 5617 Code Ave. South, Edina, Minn. 55436

[22] Filed: Mar. 17, 1976

[21] Appl. No.: 667,967

[52] U.S. Cl. ..... 259/116; 259/122; 259/124

[51] Int. Cl.[2] ..... B01F 7/20

[58] Field of Search ..... 259/122, 124, 116, 99, 259/107, 113; 222/235

[56] References Cited

UNITED STATES PATENTS

| | | | |
|---|---|---|---|
| 1,052,549 | 2/1913 | Yearta | 259/124 |
| 1,069,492 | 8/1913 | Morgan | 259/124 X |
| 1,119,637 | 12/1914 | Roberts | 259/124 X |
| 1,174,828 | 3/1916 | Copeland | 259/124 |
| 1,237,585 | 8/1917 | Tripke | 259/116 |
| 1,604,513 | 10/1926 | Hoffer | 259/113 |
| 2,291,708 | 8/1942 | Gluck | 259/113 |
| 2,713,867 | 7/1955 | Longan | 259/113 X |
| 2,726,071 | 12/1955 | Bernhardt | 259/113 |

*Primary Examiner*—Robert B. Reeves
*Assistant Examiner*—Norman L. Stack, Jr.

[57] ABSTRACT

A pitcher or similar container of generally cylindrical shape having a closure member for the open upper end of the container, a tubular housing extending axially of the container and mounted in the closure element for rotary and axial movements therein, and an axial shaft mounted in the housing for axial movements with the housing and for rotation relative to the housing. A generally disk-like impeller is mounted on the lower end of the shaft. The tubular housing and closure member have portions that cooperate to limit upward movement of the impeller from the bottom of the container to various levels above the container bottom. Retainer members operate to confine solids below a given liquid level in the container and to limit access of outside air to liquid in the container.

10 Claims, 10 Drawing Figures

LIQUID MIXING AND DISPENSING DEVICE

BACKGROUND OF THE INVENTION

This invention relates to containers for preparing beverages or liquid foods from food or other concentrates and suitable liquids, such as water, milk, and the like, and for mixing batters, whipping cream and eggs, and other similar uses. A specific use for this invention is the mixing of frozen fruit or vegetable concentrates with water to provide beverages. Generally, devices for the above-mentioned uses operate not only to mix various ingredients, but also to aerate the mixture during the mixing thereof.

SUMMARY OF THE INVENTION

An important object of this invention is the provision of a beverage or liquid food mixing and dispensing device in which, when desired, aerating of the liquid is effectively prevented during the mixing thereof, and one in which the mixing of the liquid is accomplished in a minimum time and with a minimum effort.

The liquid mixing and dispensing device of this invention involves an open-topped generally cylindrical container, a closure member for the open top of the container, a tubular housing mounted in the closure member and extending axially of the container for rotary and axial movement relative to the container and the closure member. A shaft is disposed coaxial with the tubular housing, and is mounted therein for axial movements therewith and for rotation relative to the housing and container, the shaft having opposite upper and lower ends. A disk-like impeller is mounted fast on the lower end of the shaft below said housing, and handle means is mounted on the upper end of the shaft above the housing and closure member. Cooperating stop elements on the closure member and the tubular housing limit upward movement of the impeller, shaft and housing, relative to the container and closure member, between the bottom of the container and a plurality of predetermined levels of the impeller above the bottom of the container.

DETAILED DESCRIPTION OF THE PREFERRED EMBODIMENT

Figure 1:
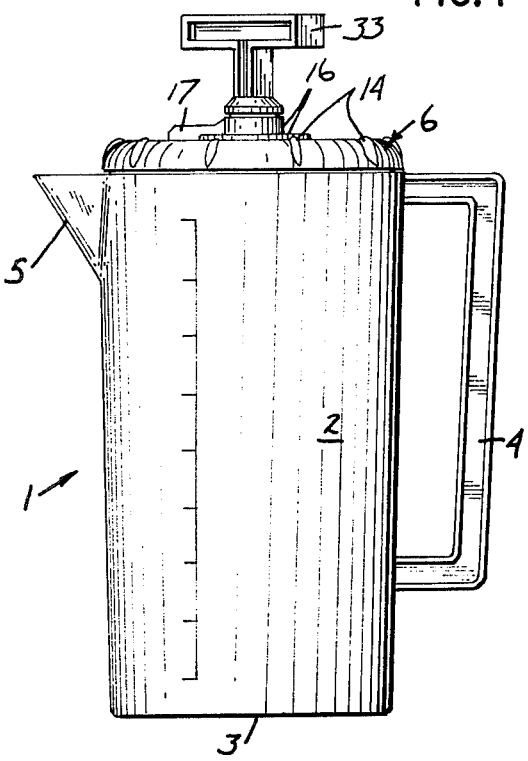
FIG. 1 is a view in side elevation of a liquid mixing and dispensing device produced in accordance with this invention.

A liquid container, indicated generally at 1, is formed from synthetic plastic material, preferably translucent to provide a generally cylindrical wall 2, a bottom wall 3, a handle portion 4 and a pouring spout 5 at the open upper end of the container 1. As shown in FIG. 1, the cylindrical wall 2 is provided with vertically spaced liquid level indicator marks thereon, which marks are used to indicate in liquid ounces the amount of liquid to be placed in the container 1 for given mixtures.

Figure 2:
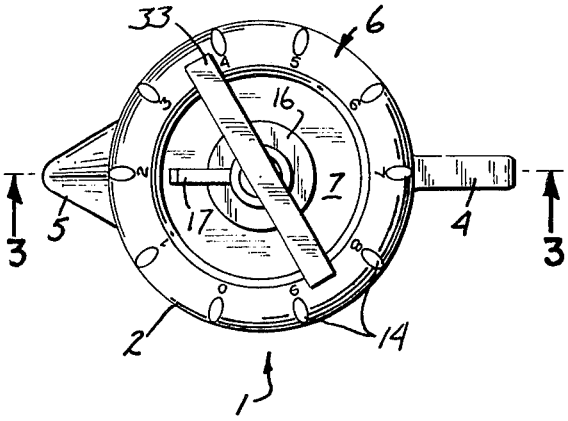
FIG. 2 is a view in top plan.

The open upper end of the container 1 is normally closed by a closure member or lid 6 having a top portion 7, and a depending annular flange or skirt 8 which closely fits within the upper end portion of the container 1, the flange or skirt 8 having an opening 9 therein which can be moved into and out of register with the pouring spout 5 responsive to rotation of the lid 6. The top portion 7 includes an axial boss or hub 10 having an axial opening 11 therethrough, the boss 10 being formed to provide a detent in the nature of a pawl 12. The lid 6 is preferably made from synthetic plastic material having resilient qualities, the pawl 12 being yieldingly urged in a direction radially inwardly of the axial opening 11. The top portion 7 and skirt 8 cooperate to define an annular shoulder 13 which rests upon the upper marginal edge of the container cylindrical wall 2. As shown in FIGS. 1 and 2, the lid 6 is provided with circumferentially spaced ribs 14 by means of which the lid 6 may be easily rotated to bring the opening 9 into or out of register with the pouring spout 5. Further, with reference to FIG. 2, it will be seen that the top portion 7 of the lid 6 is provided with circumferentially spaced indicator marks in the nature of numerals which cooperate with the liquid level markings on the side of the container 1, as will hereinafter become apparent.

Figure 7:
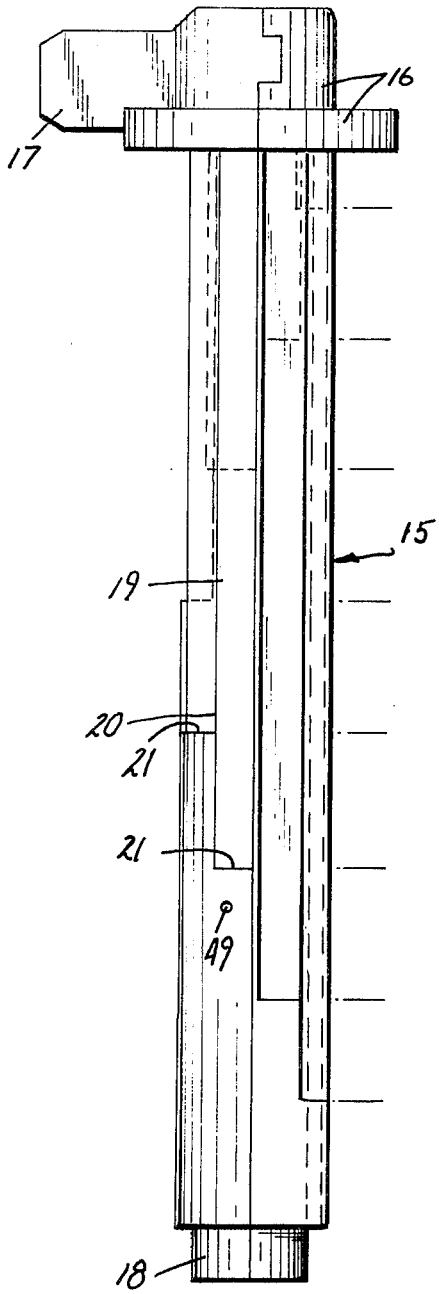
FIG. 7 is a view in side elevation of a tubular housing.
Figure 9:
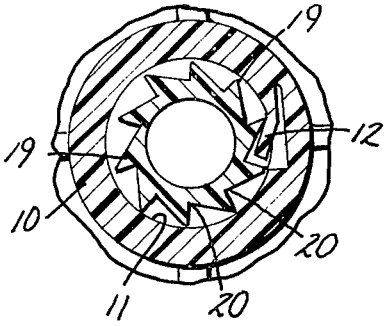
FIG. 9 is an enlarged transverse section taken generally on the line 9—9 of FIG. 3.

An elongated tubular housing 15 extends axially through the opening 11 in the hub 10, and is longitudinally split for ease of manufacture. The housing 15 is formed at its upper end portion to provide an enlarged head or flange 16 that overlies the hub 10, and a radial handle-like pointer 17. The housing 15 extends axially within the container 1 and has a diametrically reduced lower end portion 18. Below the head of flange 16, the housing 15 is formed to provide a plurality of elongated ratchet teeth 19 of various axial lengths, the teeth 19 cooperating to define axially extending grooves 20 for selective reception of the pawl 12. As shown in FIG. 7, all but one of the grooves 20 terminate in upwardly facing stop elements in the nature of shoulders 21, one of the ratchet teeth 19 and its respective groove 20 extending downwardly to the lower end portion 18 of the housing. Although not specifically shown, each of the shoulders 21 corresponds to a different one of the level indicator markings on the container side wall 2, with the exception of the uppermost scale marking thereon. By using the handle-like pointer 17, the housing may be rotated with respect to the closure member or lid 6 to cause the pawl 12 to be received in a selected one of the grooves 20, to enable the tubular housing 15 to be moved axially upwardly with respect to the container 1 and lid 6 to the extent permitted by engagement of the pawl 12 with the shoulder 21 of the groove in which the pawl 12 is received.

Figure 8:
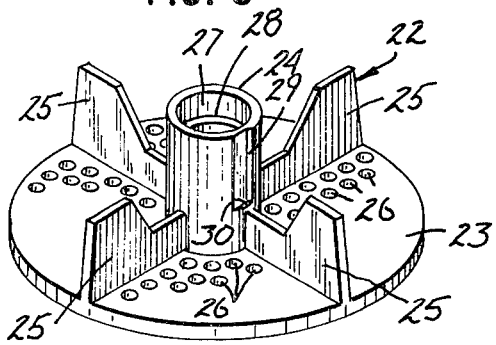
FIG. 8 is a view in perspective of a disk-like impeller.

An impeller 22 comprises a disk-like body portion 23, a central hub 24 and a plurality of circumferentially spaced radial vanes 25 that project upwardly from the body portion 23. The body portion 23 is provided with a plurality of openings 26 therethrough, the hub 24 defining an upwardly opening recess 27 having a diametrically enlarged upper end 28 for reception of the lower end 18 of the tubular housing 15. The fit betwen the recess portion 28 and the lower end portion 18 is such as to provide for free rotation of the impeller 22 relative to the tubular housing 15. With reference to FIG. 8, it will be seen that the hub 24 is formed to provide an axially extending groove 29 that is adapted to be aligned with that one of the grooves 20 that extends to the reduced diameter lower end 18 of the housing 15, the groove 29 terminating in an upwardly facing shoulder 30 for engagement with the pawl 12 when the housing 15 is raised to its uppermost position relative to the container 1 and lid 6.

Figure 3:
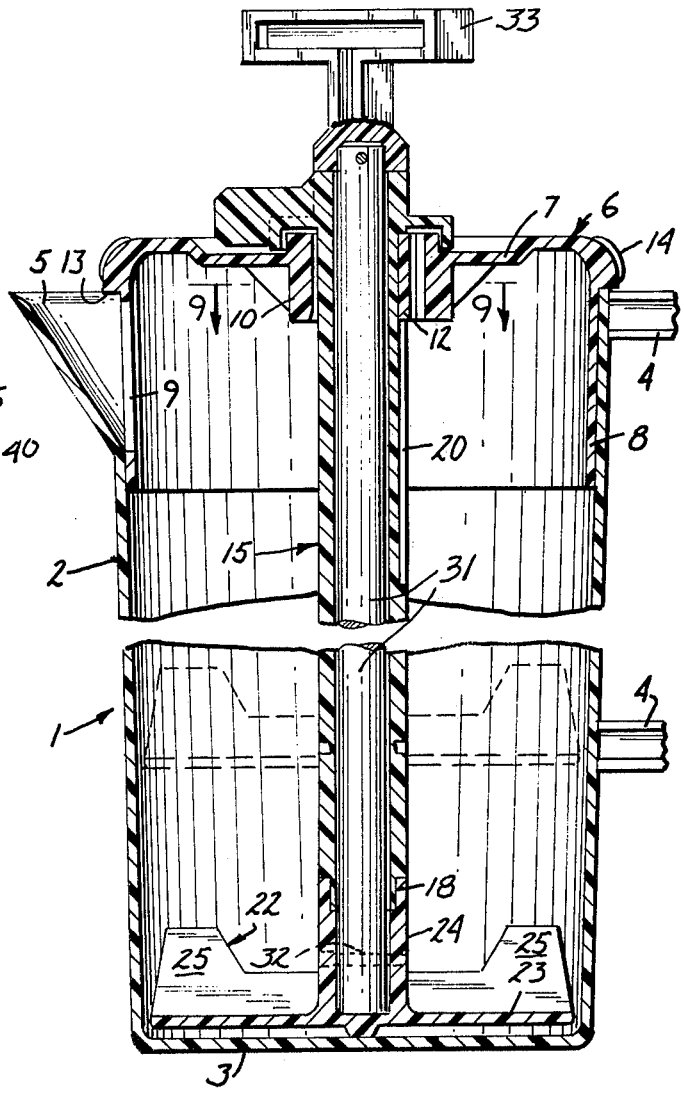
FIG. 3 is an enlarged fragmentary view in axial section, taken on the line 3—3 of FIG. 1.

Means for imparting rotation to the impeller 22, and for imparting axial movements to the impeller 22 and tubular housing 15 relative to the container 1 and lid 6, comprises an elongated shaft 31 extending through the hollow interior of the tubular housing 15 coaxially therewith, and having its lower end received in the recess 27 of the impeller 22. The impeller 22 is secured to the lower end of the shaft 31 for rotation and axial movement therewith by means of a pin 32. With reference particularly to FIG. 3, it will be seen that the body 23 of the impeller 22 is disposed in a plane transversely of the axis of the container 1 and tubular housing 15. The upper end of the shaft 31 extends above the upper end of the tubular housing 15, and is pinned or otherwise rigidly secured to an operating handle 33. The handle 33 is raised and lowered to impart axial movements to the housing 15 and impeller 22, and may be rotated to impart rotation to the shaft 31 and impeller 22 relative to the container 1 and tubular housing 15.

The above-described portions of the apparatus of this invention are particularly adapted for use in preparing beverages from liquid such as water and concentrated beverage material, such as frozen fruit juices and the like. In preparing a liquid food or beverage, the lid 6 and parts carried thereby are removed from the container 1, after which the beverage concentrate is placed in the bottom of the container 1 and water or other liquid added to the required amount. The tubular housing 15 is then rotated with respect to the lid 6 until the pointer 17 is disposed at the indicator mark on the lid 6 which corresponds to the indicator mark on the cylindrical wall 2 at the liquid level. The lid 6, with the tubular housing 15 and impeller 22 are inserted in the container 1, and the handle 33 pushed downwardly toward the bottom wall 3 of the container 1. During this downwardly movement, the concentrated becomes crushed or broken up into small pieces, after which the handle 33 is again raised to its limit of upward movement, at which limit the impeller 22 will be disposed at the level of liquid in the container. The impeller 22 will be prevented from further upward movement by engagement of the pawl 12 with the shoulder 21 in line therewith, the pawl 12 having been placed in the proper groove 20 by earlier rotation of the housing 15 with respect to the lid 6. Only a few upward and downward reciprocatory movements need to be applied to the impeller 22 by means of the handle 33, to effect thorough dissolving of the concentrate with the liquid and mixing thereof. By limiting upward movement of the impeller 22 to the level of liquid, aeration of the liquid is prevented and oxidation of the fruit or vegetable portion of the beverage kept at a minimum. Should the beverage be of the type having finely divided solids which might tend to gravitate to the bottom of the container, it is only necessary to twist the handle 33 to impart rotation to the impeller 22 to stir the contents of the container so that the particles become thoroughly mixed with the liquid.

Figure 4:
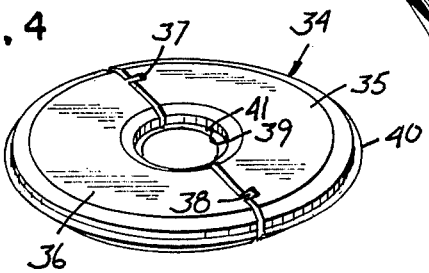
FIG. 4 is a view in perspective of a plate-like buoyant member of this invention.
Figure 5:
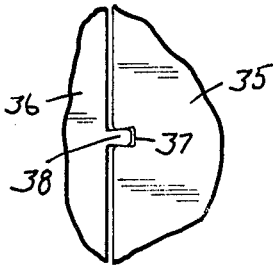
FIG. 5 is an enlarged fragmentary view in top plan of a portion of the buoyant member of FIG. 4.
Figure 10:
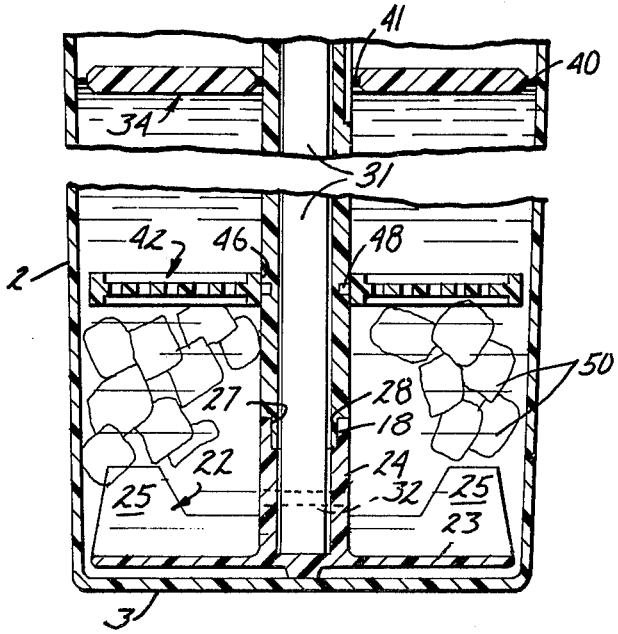
FIG. 10 is a view corresponding to a portion of FIG. 3, illustrating the use of the members shown in FIGS. 4 and 6.

To further prevent oxidation of the food particles in the beverage, when left to stand in the container over an extending length of time, I provide a flat buoyant plate 34, see FIGS. 4 and 10. The plate 34 is preferably made from suitable plastic material that is inert to chemicals in liquid beverages, and comprises a pair of semi-circular sections 35 and 36, the former defining a pair of notches 37 for reception of a pair of tenon elements 38 that project laterally outwardly from the section 36. As shown in FIG. 5, the sides of the notches 37 and of the tenon elements 38 are tapered so that the sections 35 and 36 may be snapped into engagement to provide an annular shape defining a central opening 39 adapted to loosely encompass the tubes or housing 15, as shown in FIG. 10. Each of the plate sections 35 and 36 is provided with a semi-circular marginal sealing flange 40 of suitable flexible material which slidingly engages the inner cylindrical wall surface of the container 1 to aid in keeping air from the underlying beverage and oxidizing the same. Inner flexible flanges 41 may be used to engage the outer surface portions of the tubular housing 15 for the same purpose.

Figure 6:
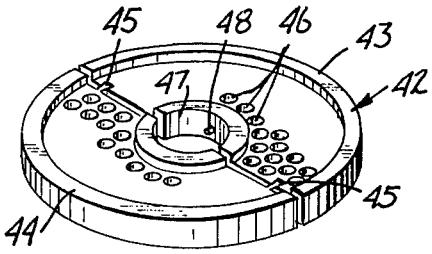
FIG. 6 is a view in perspective of a retainer plate of this invention.

A retainer plate 42 is shown in FIGS. 6 and 10 as comprising a pair of semi-annular retainer sections 43 and 44 that are releasably held together by notch and tenon connections, indicated at 45, in the same manner as are the sections 35 and 36. The retainer sections 43 and 44 are provided with openings 46 therethrough and cooperate to define a central opening 47 for reception of the tubular housing 15. The retainer sections 43 and 44 are provided with a pair of diametrically opposed pins 48 projecting radially inwardly of the opening 47, and which are adapted to project into diametrically opposed openings 49 in the tubular housing 15, to support the retainer plate 42 in upwardly spaced relation to the impeller 22. The retainer plate 42 cooperates with the impeller 22, as shown in FIG. 10, to retain solids therebetween when mixing a liquid food or beverage such as certain soups or iced beverages. In FIG. 10, a plurality of ice cubes 50 are shown as being confined between the impeller 22 and retainer plate 42, so that the ice may be moved upwardly and downwardly through the beverage to effectively cool the same. Further, the retainer plate 42 holds the ice cubes from being poured out from the container with the beverage.

The apparatus of this invention is capable of many uses other than those above described, with or without the retainer plate 42 or buoyant plate 34. For instance, the housing 15 may be adjusted relative to the lid 6 so that the impeller 22 may be raised above the liquid level in the container 1 to aerate the liquid mixtures, if desired. The apparatus is highly effective in beating eggs and mixing batter for waffles, pancakes and the like, and for other purposes wherein extremely rapid and thorough mixing is required.

While a commercial embodiment of our liquid mixing an dispensing device has been described, it will be understood that the same is capable of modification, and that modification may be made without departure from the spirit and scope of the invention as defined in the claims.

What is claimed is:

1. A liquid mixing and dispensing device comprising:
   a. an open-topped, generally cylindrical container;
   b. a closure member for the open top of said container;

c. a tubular housing mounted in said closure member and extending axially of said container for rotary and axial movement relative to said container and closure member;

d. a shaft coaxial with said tubular housing and mounted therein for axial movements therewith and for rotation relative to said housing and container, said shaft having opposite upper and lower ends;

e. a disk-like impeller mounted fast on the lower end of said shaft below said housing;

f. handle means on the upper end of said shaft above said housing and closure member;

g. and cooperating stop elements on said closure member and said tubular housing for limiting upward movement of said impeller, shaft and housing, relative to said container and closure member, between the bottom of said container and a plurality of predetermined levels above said bottom of the container.

2. The liquid mixing and dispensing device defined in claim 1 in which said stop means comprises a plurality of axially spaced abutment elements on said housing and a cooperating stop element on said closure member, said abutment elements being movable selectively into alignment with said stop element.

3. The liquid mixing and dispensing device defined in claim 2 in which said tubular housing defines a plurality of circumferentially spaced grooves extending axially downwardly from the upper end of said tubular housing, said grooves being of different axial length, the lower ends of said grooves defining said abutment elements.

4. The liquid mixing and dispensing device defined in claim 3 in which said housing includes ratchet teeth defining said grooves, said stop element comprising a pawl in said closure member yieldingly urged toward engagement with said ratchet teeth.

5. The liquid mixing and dispensing device defined in claim 1 in which said impeller comprises a disk portion disposed in a plane transversely of the axis of said shaft and housing and having a plurality of openings therethrough for passage of liquids and a plurality of generally radial agitator vanes projecting upwardly from said disk portion.

6. The liquid mixing and dispensing device defined in claim 1 in further combination with a perforate retainer plate, and support means for holding said retainer plate on said tubular housing in axially spaced relation to said impeller.

7. The liquid mixing and dispensing device defined in claim 6 in which said retainer plate comprises a pair of segmental sections cooperating to define a central opening, and means for releasably securing said sections together, said support means comprising support pins and pin receiving openings in respective ones of said retainer plate and tubular housing.

8. The liquid mixing and dispensing device defined in claim 1, characterized by generally flat buoyant plate means having a circular outline, said plate means further having an axial opening therethrough for loosely receiving said tubular housing.

9. The liquid mixing and dispensing device as defined in claim 8 in which said plate means includes a marginal sealing flange of flexible material projecting radially outwardly therefrom for sliding engagement with the inner cylindrical surface of said container, and a second sealing flange in axial opening for engagement with said tubular housing.

10. A liquid mixing and dispensing device comprising:

a. an open topped generally cylindrical container of translucent material having vertically spaced liquid level indicator marks thereon;

b. a closure member for the open top of said container, said closure member having an axial opening therethrough and circumferentially spaced liquid level indicator marks radially outwardly of said opening and corresponding to said marks on said container;

c. a tubular housing extending axially within said container and journaled in said closure member for rotary and axial sliding movements relative to said closure member;

d. said tubular housing having a radially projecting indicator pointer upwardly of said closure member for imparting rotary movement to said housing;

e. a shaft coaxial with said tubular housing and mounted therein for axial movements therewith and for rotation relative to said housing and container, said shaft having opposite upper and lower ends;

f. a disk-like impeller mounted fast on the lower end of said shaft below said housing;

g. handle means on the upper end of said shaft above said housing and closure member;

h. a stop element in said axial opening of the closure member;

i. and a plurality of axially and circumferentially spaced abutment elements on said tubular housing selectively axially aligned with said stop element responsive to rotation of said housing, each of said abutment elements engaging said stop element responsive to upward movement of said housing and impeller to limit upward movement thereof to the level of a different one of said level indicator markings on said container.

* * * * *